350-333 SR
3/9/82 XR 4,319,237

United States Patent [19]
Matsuo et al.
[11] 4,319,237
[45] Mar. 9, 1982

[54] BRIGHTNESS ADJUSTING CIRCUIT OF LIQUID CRYSTAL MATRIX PANEL FOR PICTURE DISPLAY

[75] Inventors: Tamotsu Matsuo, Osaka; Susumu Ide, Katano; Hiroyuki Irie, Osaka, all of Japan

[73] Assignee: Matsushita Electric Industrial Co., Ltd., Osaka, Japan

[21] Appl. No.: 120,000

[22] Filed: Feb. 8, 1980

[30] Foreign Application Priority Data

Feb. 14, 1979 [JP] Japan ..... 54-16606
Jun. 19, 1979 [JP] Japan ..... 54-77330
Sep. 20, 1979 [JP] Japan ..... 54-121101

[51] Int. Cl.[3] ..... G09G 3/36
[52] U.S. Cl. ..... 340/713; 340/784; 350/333
[58] Field of Search ..... 340/713, 714, 784; 350/332, 333, 351

[56] References Cited

U.S. PATENT DOCUMENTS 4,040,721 8/1977 Kurita ..... 350/333
4,045,791 8/1977 Fukai et al. ..... 340/713
4,082,430 4/1978 Schulthess et al. ..... 350/333
4,233,603 11/1980 Castleberry ..... 350/333

FOREIGN PATENT DOCUMENTS 133896 10/1979 Japan ..... 340/713

OTHER PUBLICATIONS

"Liquid Crystal Matrix Display" by Bernard J. Lechner et al., Proceedings of the IEEE, vol. 59, No. II, Nov. 1971, pp. 1566–1579.
"Liquid Crystal Video Display", Technical Staff Hughes Aircraft Co/IPD, Electro-Optical Systems Design, Sep. 1976, (3 pages).

*Primary Examiner*—Marshall M. Curtis
*Attorney, Agent, or Firm*—Stevens, Davis, Miller & Mosher

[57] ABSTRACT

A drive circuit drives a liquid crystal display device of the type in which liquid crystal fills a space between an X-Y matrix substrate having a number of picture elements each including a switching element, and a common electrode plate. The drive circuit provides an optimum picture displayed to an observer in accordance with ambient conditions such as light and temperature. To this end, a DC bias voltage to determine the operating point of the liquid crystal display device is applied to the common electrode. The brightness of the displayed picture may be controlled by adjusting the DC bias voltage. The DC bias is changed in accordance with a change in an amount of ambient light or ambient temperature. Furthermore, in accordance with the fall of the ambient temperature the DC voltage applied to the common electrode is made to oscillate at a frequency to which the liquid crystal is insensitive, with respect to the bias point. At this time, the amplitude of the oscillation is made large.

3 Claims, 15 Drawing Figures

BRIGHTNESS ADJUSTING CIRCUIT OF LIQUID CRYSTAL MATRIX PANEL FOR PICTURE DISPLAY

There has been proposed an X-Y matrix liquid crystal panel of an IC array having picture elements each including a switching transistor and a memory element arrayed on a single silicon wafer. In FIG. 1 illustrating schematically the liquid crystal panel, numeral 1 designates a liquid crystal cell, numeral 2 designates a memory capacitor and numeral 3 a MOS field effect transistor (abbreviated as MOS FET). A set of those elements constitute one picture element. Further, numeral 4 is an X electrode, 5 is a Y electrode, 6 is a scanning signal generator section, and numeral 7 is a video signal processing circuit for converting serial video signals into parallel video signals of the number of the Y electrodes. The reason why the MOS FET 3 and the memory capacitor 2 are provided for each picture element depends upon the fact that cross talk in the liquid crystal matrix panel must be prevented and a low reaction rate of the liquid crystal itself must be compensated.

Next, the drive of the liquid crystal matrix panel shown in FIG. 1 will be explained as follows: The X electrodes 4 are successively selected every horizontal scanning in the line sequential system. On the other hand, video signals are sampled and held by the video signal processing circuit 7 and converted into parallel signals corresponding to the number of the Y electrodes 5. The parallel converted video signals are simultaneously applied to each of the Y electrodes 5 every horizontal scanning period. In the picture elements arranged along the selected X electrode, the MOS FET 3 are simultaneously turned on and the memory capacitors 2 associated therewith are charged with the voltages corresponding to the video signals. The voltages stored in the memory capacitors 2 are held until the MOS FETs are next turned on, after those are turned off. During this period, each liquid crystal cell 1 is continuously driven by a difference between the voltage stored in the memory capacitor 2 and the voltage Vc at a common electrode terminal 8.

Accordingly, in a liquid crystal display panel of the reflecting type in which light rays scattered at the liquid crystal are reflected by a matrix substrate, the black level of the video signal is set at a voltage level near the threshold voltage of the liquid crystal while the white level of the video signal is selected at a voltage level near the voltage at which the saturation of the liquid crystal starts. When the black and white levels are so selected, the video signals may be reproduced.

As shown in FIG. 2, when an incident light coming from a light source is angularly separated by an angle $\theta$ from a light reflecting from the matrix surface toward an observer, the threshold voltage and the saturation voltage change depending on the angle $\theta$. An example of those voltage changes, i.e. a viewing-angle dependancy of a liquid crystal scattering characteristic is shown in FIG. 3. As shown, two cases of the viewing-angle dependancy for $\theta=\theta_1$ and $\theta=\theta_2$ are depicted in the graph in FIG. 3 where the X-axis represents an impression voltage and the Y-axis represents an intensity of reflecting light rays. In the graph, $V_{th1}$ and $V_{th2}$ stand for threshold voltages and $V_{s1}$ and $V_{s2}$ stand for saturated voltages. As seen from the graph, the scattering characteristic of the liquid crystal depends on a viewing angle at which an observer views the liquid crystal. Accordingly, to obtain the optimum picture, it is necessary to adjust the level of the video signal in accordance with the viewing angle. The scattering characteristic of the liquid crystal also depends on temperature in addition to the viewing angle. Further, the ambient light influences the impression voltage to provide the optimum scattering level. Accordingly, the impression voltage must be adjusted in accordance with the ambient conditions.

There has been known a circuit to effect such an adjustment which is shown in FIG. 4. In the figure, reference numeral 7 designates a video signal processing circuit which is the same as that shown in FIG. 1 and is composed of subcircuits 7-1 to 7-3, for example, single chips of IC. Output terminals 13-1 to 13-N of the video signal processing circuit 7 are connected to a liquid crystal matrix panel (not shown). In the figure, reference numeral 14 designates a video signal input terminal; 9 a video amplifier; 10 a variable resistor for changing the DC level at the input terminal of the video amplifier 9; 11 and 12 DC power source terminals. The input signal to the video amplifier 9 is the sum of a video signal from the terminal 14 and a DC voltage derived from a midpoint of the variable resistor 10. Accordingly, the DC level of a video signal going to the video signal processing circuit 7 and thus the levels of the output signals from the output terminals 13-1 to 13-N may be properly changed by adjusting the variable resistor 10. This level adjusting method is similar to the brightness adjusting method commonly used in a picture display by CRT. However, the level adjusting method, when applied to the liquid crystal matrix panel, has the following disadvantages. Firstly, each circuit of the video signal processing circuit 7 must have a good linearity at the respective levels of the video signal and at those levels including the DC level change by the variable resistor 10. In other words, the video signal processing circuit 7 must have a sufficiently wide operating range. This results in increase of the power consumption in the video signal processing circuit 7 and a high voltage withstanding of the circuit elements. The video signal processing circuit 7 actually includes several ICs, as shown in FIG. 4. In order to correct a characteristic variation among the used ICs must be used in the video signal processing circuit 7. In this case, however, a change of the DC level by the variable resistor 10 must be taken into account in the correcting operation. For this, the correcting operation is very difficult. This is a second disadvantage of the level adjusting method.

The study by the inventors of the present patent application showed that a photoconductive characteristic of the MOS FET 3 provides a problem in the panel drive for its display. Assume now that the MOS FET 3 is of P-channel type, and a semiconductor substrate voltage $V_B$ is at ground potential ($V_B=0$), and a video signal voltage to charge the memory capacitor through the MOS FET 3 from the Y electrode 5 is represented by $V_d$. When the liquid crystal matrix panel is driven under a condition $V_c<V_d<V_B=0$, the external light irradiation onto the MOS FET 3 makes the memory capacitor discharge through the substrate due to its photoconductive characteristic, even though the MOS FET 3 is OFF. Accordingly, the voltage $V_d$ charged in the capacitor 2 grows with time to be a voltage $V_d'$·($V_d<V_d'$). Therefore, the larger becomes the voltage to drive the liquid crystal cell 1, the larger becomes an amount of light irradiated. A change of the video signal voltage $V_d$ charged in the memory capacitor 2 becomes small by a leakage current due to the photoconductive characteristic. For this reason, a picture displayed on the panel has a higher brightness as the amount of irradiation light increases, so that the contrast of the picture becomes poor. Thus, the picture quality of the displayed picture is greatly influenced by the photoconductive characteristic of the MOS FET 3.

As well known, the scattering characteristic depends on temperature and therefore some countermeasure must be taken to compensate for the temperature dependancy.

A numeral/character display device, commonly and widely used, employs a two-value display system of black and white. Accordingly, if a voltage sufficiently lower than the threshold voltage $V_{th}$ and a voltage sufficiently higher than the saturation voltage $V_S$ are used for the two-value display voltages, there is no need for compensation of the threshold voltage for temperature changes. In a display device particularly designed for displaying faithfully a graduation of a picture, however, it is necessary to set the black level of the video signal to be near the threshold voltage of the liquid crystal. Assuming that the threshold voltage at the ambient temperature 40° C. is $V_{th1}$ and that at the ambient temperature 0° C. it is $V_{th2}$, as shown in FIG. 5, it is necessary to properly change the voltage applied to the liquid crystal to set the black level of the video signal from $V_{th1}$ to $V_{th2}$ as the ambient temperature changes from 40° C. to 0° C.

A circuit construction shown in FIG. 6 is one of the ways to satisfy the above. In the circuit of FIG. 6, the DC level of the video signal applied to the video signal processing circuit 7 shown in FIG. 1 is changed in accordance with temperature. In the figure, reference numeral 15 designates a video input terminal; 16 a resistor having a temperature dependancy; 17 and 18 bias resistors of a transistor; 19 a load resistor; 20 a video amplifying transistor; 21 an emitter feedback resistor; 7 a video processing circuit as shown in FIG. 1. With such a construction, the DC level of the video signal applied to the video signal processing circuit 7 may be changed in accordance with the ambient temperature if a temperature coefficient of the temperature-dependant resistor 16 is selected to be a positive or negative value. Accordingly, the DC level of the signal applied to each picture element of the matrix can be changed.

The circuit shown in FIG. 6 has the following disadvantages, as in the example mentioned above. The circuit 20 and the succeeding one shown in FIG. 6 must have good linearity for the purpose of amplifying the video signal with good linearity and for providing the DC voltage for the temperature compensation as well. In other words, the signal processing circuit 7 must have a wide linear range of operation.

A liquid crystal display panel to which the invention is directed compensates for a low rise time in the reaction rate of the liquid crystal per se. Here, the rise time means a time to reach the scattering state when a DSM liquid crystal is used or a response time when the video signal changes from a black level to a white level. On the other hand, in order to display the video signal, it is necessary to shorten the decay time in the reaction time of the liquid crystal. This is necessary particularly when ambient temperature is low. Here, the decay time means a time taken for returning the scattering state to the original state when the DSM liquid crystal is used. An example of the drive system to shorten the decay time is disclosed in an article by B. J. Lechner et al in IEEE Vol. 59, No. 11, November 1971. The major construction in the article will be described referring to FIG. 7. As shown, three MOS FETs in FIG. 1 are replaced by two diodes 22 and 23 and electrode lines 24 and 25 for applying signals to shorten the decay time are additionally used. Reference numerals 26 and 27 respectively designate a liquid crystal cell and a memory capacitor and those correspond to the liquid crystal 1 and the memory capacitor 2 shown in FIG. 1, respectively. Reference numeral 28 designates an electrode line for applying parallel video signals and corresponds to 5 shown in FIG. 1. Reference numeral 29 designates an electrode line to reset a signal voltage of the memory capacitor. A video signal processing circuit 30 and a scanning signal generating circuit 31 are the same as those 7 and 6 shown in FIG. 1, respectively. Reference numeral 32 is a reset signal source to reset the capacitor 27. Numeral 33 designates an erasing AC signal generating circuit. In the example shown in FIG. 7, signals are applied to the memory capacitors by using the diodes, so that the electrode lines 29 for the reset and the signal source 32 are needed. The essentially different point of the example in FIG. 7 from that in FIG. 1 resides in the erasing AC signal generating circuit 33 for producing an AC signal on the electrode lines 24 and 25.

When operating, the scanning signal generating circuit 31 selects one of the electrode lines 25 while at the same time video signals from the video signal processing circuit 30 are simultaneously applied to the memory capacitors, through the electrode lines 28, respectively. At this time, the video signal processing circuit 30 and the scanning signal generating circuit 31 have been biased so as to turn on the diodes 22. The biasing is of course such that, when the other electrode lines 25 are selected, the diodes 22 are turned off. By using the period of 5 ms at the end of each frame, the reset signal source 32 sequentially applies reset signals to the capacitors, through the electrode lines 29 and the diodes 23 thereby to reset the capacitors 27 to zero level. After this, the AC signal generating circuit 33 applies an AC signal of about 15 KHz between each pair of the electrode lines 24 and 25 and is applied as an erasing signal to the liquid crystal cell 26. At this time, the liquid crystal cell 26 and the capacitor 27 are connected in series; however, the capacitance of the capacitor 27 is much larger than that of the liquid crystal cell 26. Therefore, most of the AC voltage is applied to the liquid crystal cell 26. The application of the AC signal of about 15 KHz considerably improves the decay time. However, even if the diodes 22 and 23 are replaced by the MOS FETs shown in FIG. 1, either one of the electrode lines 24 or 25 is divided for each line and the total number of the X electrodes shown in FIG. 1, or the number of the electrode lines 4, is needed. The circuit construction corresponding to each line is required for the erasing signal generating circuit 33. As a result, there was a disadvantage in that the peripheral circuit was complicated.

Accordingly, a first object of the invention is to provide a picture display liquid crystal panel which can provide the best picture quality to an observer under any ambient conditions.

A second object of the invention is to provide means capable of adjusting the scattering level of the liquid crystal by the observer.

A third object of the invention is to compensate for a change in the scattering level of a displayed picture caused by the discharge of the memory elements in accordance with the picture information which is due to the photoconductive characteristic of a switching transistor of each picture element.

A fourth object of the invention is to compensate for the scattering level of a displayed picture caused by a change in the threshold voltage as ambient temperature changes.

A fifth object of the invention is to prevent the deterioration of the decay time of the liquid crystal caused by a decrease in ambient temperature.

A liquid crystal display panel to which the invention is directed is formed by filling with liquid crystal in a space between a substrate having an X-Y matrix formed on a single silicon wafer and a front glass with a common transparent electrode. Each picture element as a cross-point of the X-Y matrix includes a switching element and a memory element.

A drive circuit according to the invention manually adjusts a DC voltage applied to the common electrode of a liquid crystal display panel in accordance with an angle at which an observer views the panel and at the discretion of the observer, and is capable of adjusting the amount of ambient light around the panel, automatically adjusting the voltage according to ambient temperature, and creates oscillation in the voltage at a frequency to which the liquid crystal does not respond.

Other objects and features of the invention will be apparent from the following description taken in connection with the accompanying drawings, in which.

Figure 1:
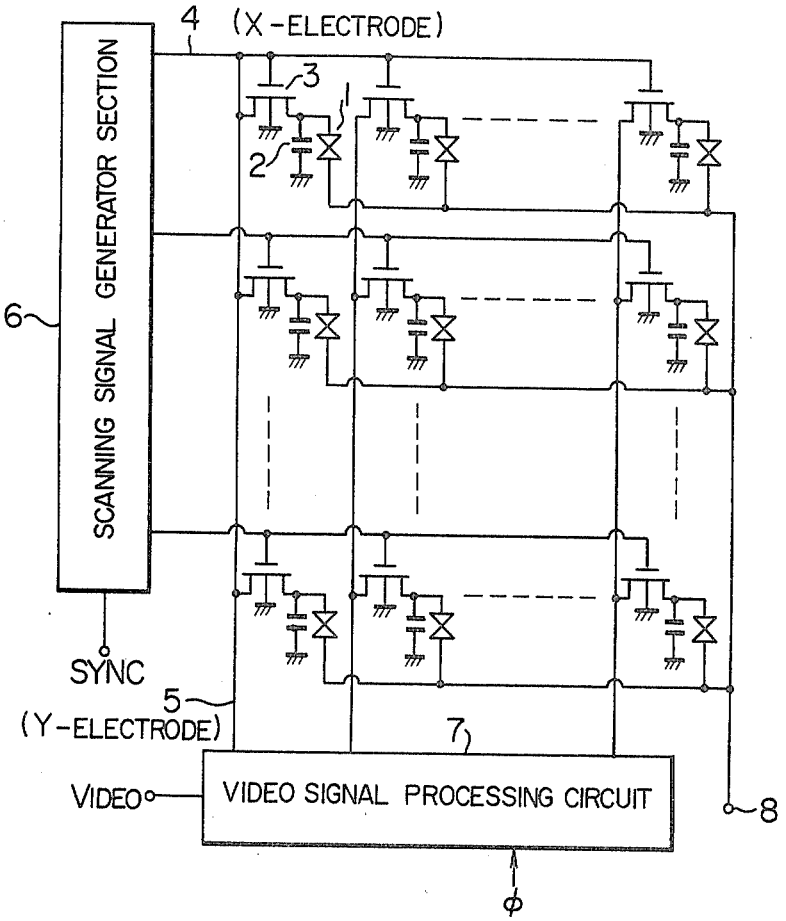
FIG. 1 is a schematic circuit diagram of a liquid crystal matrix display panel to which the invention is directed and its periphery circuits.
Figure 2:
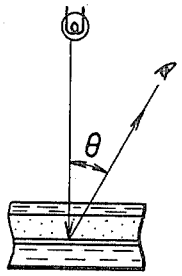
FIG. 2 illustrates a viewing angle $\theta$ to the display panel.
Figure 3:
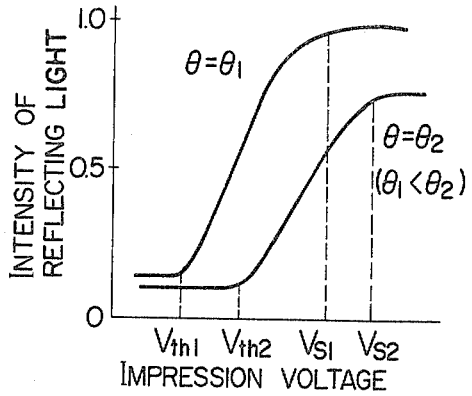
FIG. 3 shows a graph illustrating a viewing-angle dependancy in the scattering characteristic of a liquid crystal.
Figure 4:
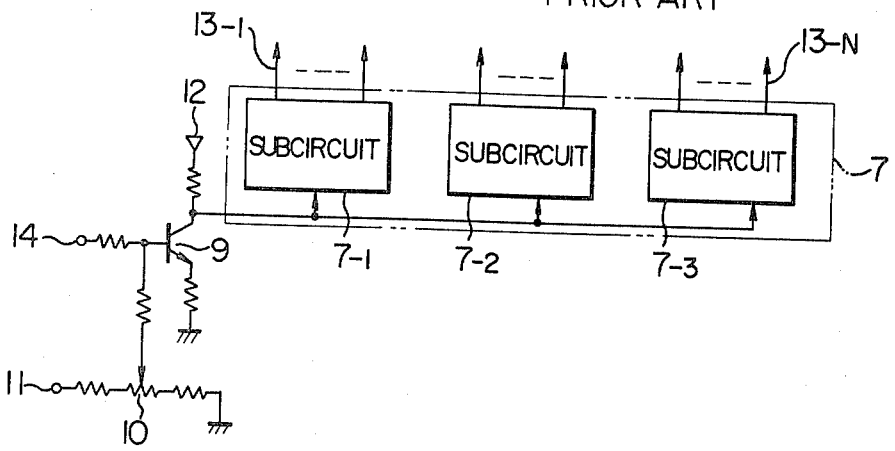
FIG. 4 PRIOR ART
FIG. 4 shows a circuit diagram of a conventional circuit for adjusting the scattering level of the liquid crystal.
Figure 5:
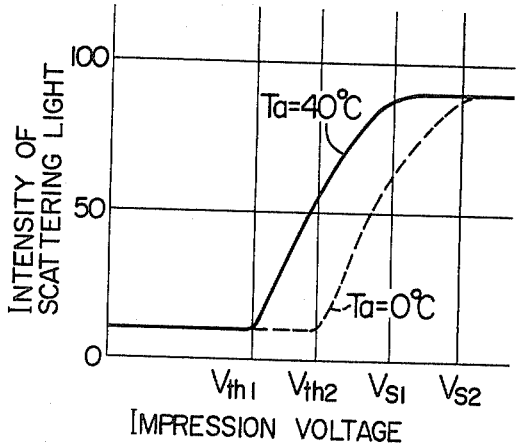
FIG. 5 shows the graph for illustrating a temperature-dependancy of the scattering characteristic of the liquid crystal.
Figure 6:
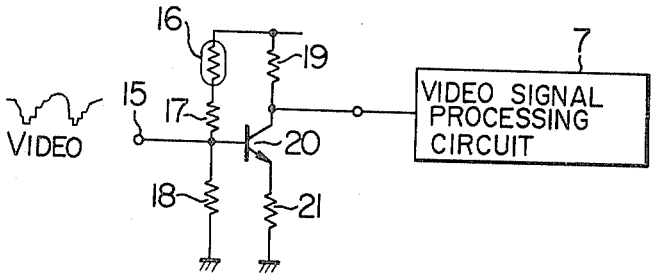
FIG. 6 PRIOR ART
FIG. 6 shows a circuit diagram of a conventional circuit for compensating for a change in the scattering level due to the temperature-dependancy of the scattering characteristic shown in FIG. 5.
Figure 7:
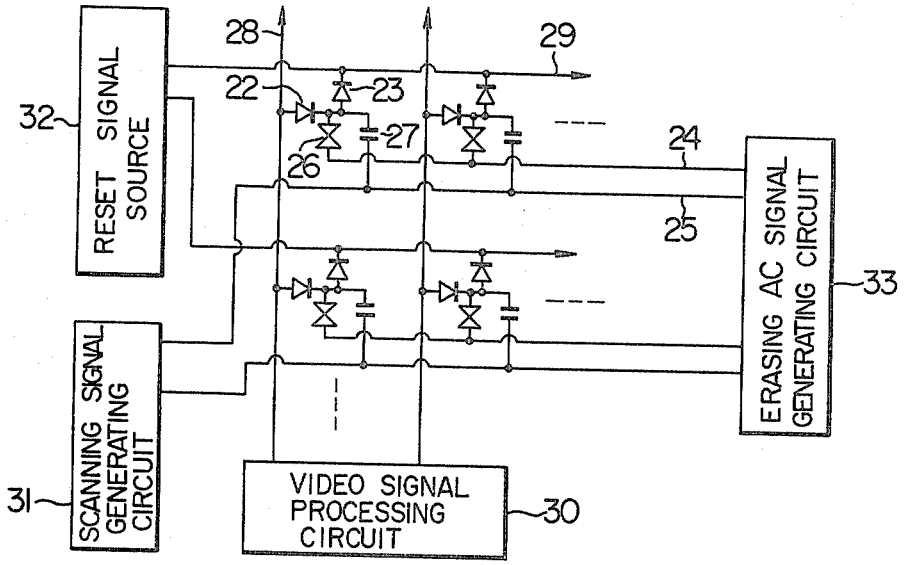
FIG. 7 PRIOR ART
FIG. 7 shows a circuit diagram of a conventional circuit to improve the decay time of the liquid crystal.
Figure 8:
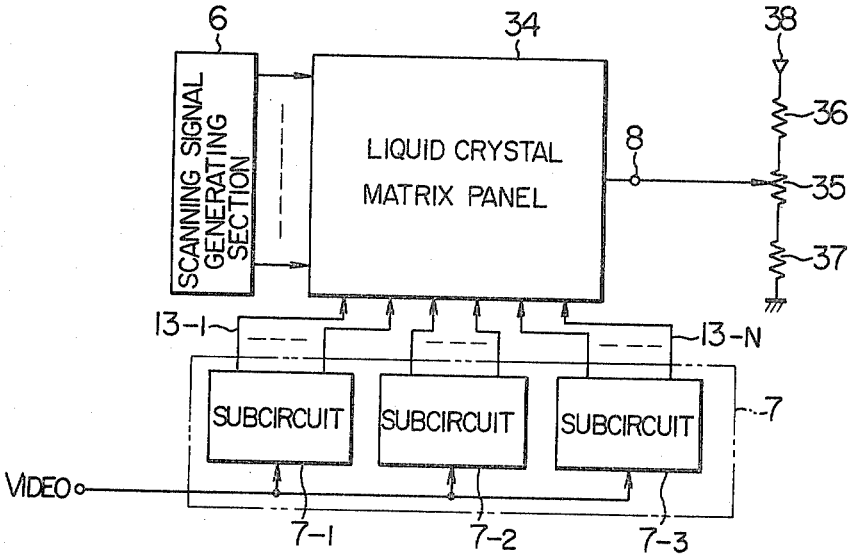
FIG. 8 is block diagram of an embodiment of a drive circuit for a liquid crystal display panel according to the invention in which the scattering level of the liquid crystal is adjusted by changing a DC voltage applied to common electrodes by means of a variable resistor.

FIG. 8 shows a block diagram of an embodiment of a drive circuit for a liquid crystal display device according to the invention. In the figure, like reference numerals are used to designate like blocks shown in FIGS. 1 and 4. In a liquid crystal matrix panel 34, X-electrodes are connected to a scanning signal generating section 6 and Y-electrodes to a video signal processing circuit 7. As described above, a terminal 8 is a common electrode. The voltage applied to the liquid crystal is a difference between an electrode voltage at each picture element of the liquid crystal matrix panel and a voltage applied to the common electrode. Accordingly, changing a DC level of a video signal is quite equivalent to changing a voltage at the common electrode. In FIG. 8, reference numeral 38 is a DC voltage source terminal, numeral 35 is a variable resistor for adjusting the voltage applied to the common electrode 8, and numerals 36 and 37 are fixed resistors for limiting a variable range of the variable resistor 35. With such a construction, the voltage applied to the common electrode may be adjusted to a voltage providing an optimum scattering level regardless of an observing condition i.e. a change in a viewing angle, and ambient condition such as temperature and light. Accordingly, all the problems of the conventional adjusting circuit shown in FIG. 4 can be solved. Since the resistance value of the liquid crystal is large, resistors with high resistance may be selected for the resistors 35 to 37. Little power is consumed by the resistors 35 to 37. This greatly contributes to power consumption savings for the whole device. In other words, the DC voltage applied to the liquid crystal may be freely controlled without widening the operating range of the video signal processing circuit. When the DC component is changed by the video signal processing circuit, there is a possibility that the scattering of DC component changes occurs among the respective picture elements. However, the drive circuit of the invention provides entirely uniform voltage changes to the picture elements. Further, the voltage applied to the common electrode may be controlled without increasing the power consumption in the video circuit, thereby providing an optimum picture under any observing condition and any exterior condition.

More specifically, when a picture quality is deteriorated as a result of the dependency of the scattering characteristic of the liquid crystal on viewing angle, or when the external light irradiation onto the liquid display panel increases the leakage current of the MOS FET to deteriorate the brightness or the contrast of a picture, a picture with desired picture quality may be obtained by adjusting the DC voltage applied to the common electrode.

A drive circuit capable of preventing degradation of picture quality displayed by the liquid crystal display panel due to a temperature change, which is an embodiment of the invention, will be described.

Figure 9:
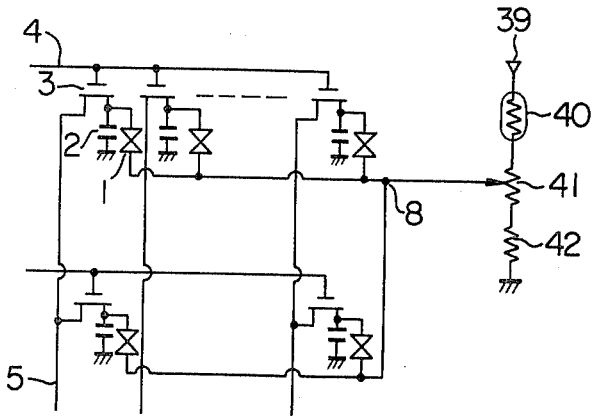
FIG. 9 is a circuit diagram of a second embodiment of the invention which is a circuit for compensating for a change of the scattering level due to a change of ambient temperature by changing the DC voltage applied to the common electrode in accordance with the change of ambient temperature.

Three embodiments for automatically compensating for a scattering level change caused by a change of the threshold voltage Vth when the temperature changes, will first be described referring to FIGS. 9 to 11. In the figures, reference numerals 1 to 5 designate those designated by the same numerals in FIG. 1. Reference numeral 39 designates a DC power source terminal, 40 is a temperature-dependent resistor, 41 is a variable resistor for adjusting the common electrode voltage, and 42 is a fixed resistor. With such a construction, if the temperature coefficient of the resistor 40 is set to a proper positive or negative value, the common electrode voltage may be changed in accordance with temperature. In other words, the voltage applied to the liquid crystal may be changed to compensate for a change of the threshold voltage of the liquid crystal due to a change in the ambient temperature. In the above-mentioned embodiment, the temperature-dependant resistor is used for the resistor 40, however, such a resistor may be used for both the resistors 40 and 42. Accordingly, the above-mentioned embodiment can make temperature compensation without any additional requirement for the video signal processing circuit 7.

Figure 10:
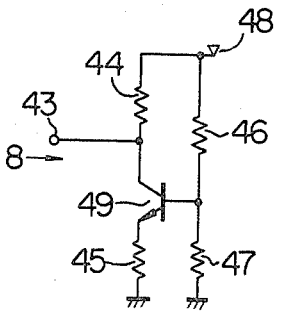
FIGS. 10 and 11 are third and fourth embodiments of the invention which are the circuits for compensating a scattering level change by an ambient temperature change as shown in FIG. 9.

Turning now to FIG. 10, there is shown another embodiment of the invention. In the figure, numeral 43 is a terminal connected to a common electrode terminal of a matrix panel. Numerals 44 to 47 are resistors. Numeral 48 designates a power source terminal. Numeral 49 is a transistor. The embodiment of FIG. 10 takes an advantage of a change ($\Delta V_{BE}$) of the potential between the base and emitter of the transistor 49. A voltage change at the terminal 43 is approximately given by $\Delta V_{BE} \times R_1/R_2$ where the resistors 44 and 45 have resistances $R_1$ and $R_2$, respectively. Accordingly, by properly selecting resistances of the resistors 44 and 45, it is possible to obtain a proper voltage change within a wide range. Although the embodiment employs the transistor of NPN type, a PNP transistor may also be used with a change in the reverse direction.

Figure 11:
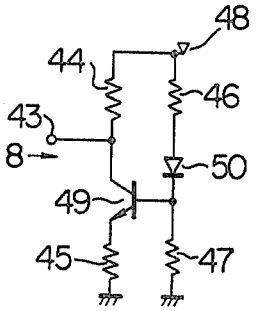

FIG. 11 shows a fourth embodiment of the invention which corresponds to the embodiment of FIG. 10 with the addition of a diode 50. A plurality of diodes may be used for the diode 50 and the diode 50 may be inserted between the emitter of the transistor 49 and ground.

Figure 12:
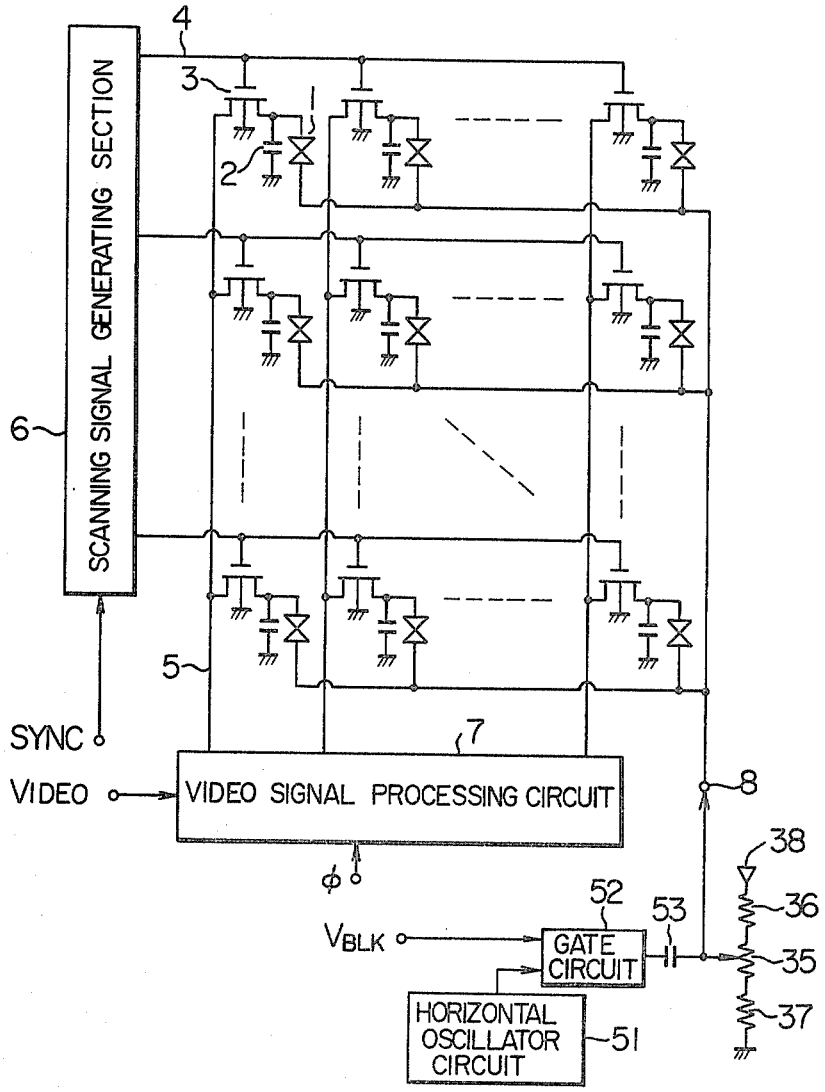
FIG. 12 is a circuit diagram of the fifth embodiment of the invention which is a circuit for improving the decay time of the liquid crystal by superimposing an AC signal with a frequency to which the liquid crystal does not respond on the DC voltage applied to the common electrode.
Figure 13:
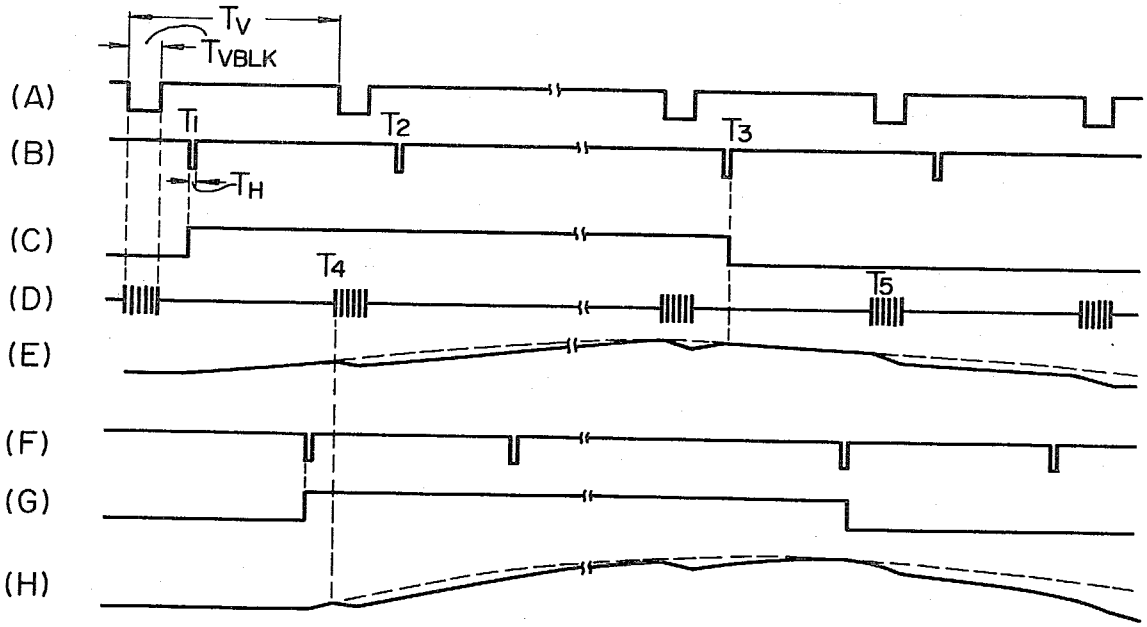
FIG. 13 shows a set of waveforms for illustrating the operation of the circuit shown in FIG. 12.

A fifth embodiment of the invention to be given below is more improved in the temperature dependancy of the picture quality of a picture. The reaction time of the liquid crystal is slower as temperature is lower. Particularly, the decay time is more slower than the rise time. In displaying a rapid motion picture, a called trailing phenomenon takes place, which in turn brings about an after image of the picture and thereby the picture quality is damaged. The FIG. 12 embodiment improves the decay time problem to provide a quick responsive picture by the liquid crystal. The major feature of this embodiment resides in that the voltage applied to the common electrode oscillates with respect to a fixed DC potential at a frequency at which the liquid crystal is insensitive. More specifically, an erasing AC signal to which the liquid crystal is insensitive is superposed on the DC voltage of the common electrode. There are two ways to superpose the erasing signal on the DC voltage; one way superimposes the erasing signal over the entire period of the video signal and the other way superimposes it to the DC voltage during the vertical flyback period. The former way will easily be understood when the latter way is understood. For this, only the latter way will be described in detail referring to FIGS. 12 and 13. FIG. 12 shows a circuit diagram of the fifth embodiment and FIG. 13 shows waveforms useful for illustrating the operation of the circuit of FIG. 12. In FIG. 12, like reference numerals are used for designating like portions in FIGS. 1 and 8.

In FIG. 13, (A) denotes a vertical synchronizing signal as a reference, $T_V$ one field period, and $T_{VBLK}$ a vertical flyback period. (B) designates an output signal from the scanning signal generating section 6, which is synchronized with a horizontal synchronizing signal applied to the X-electrode 4. $T_H$ is one horizontal scanning period. (C) is a potential of the memory capacitor 2 of each picture element of the panel. (D) is an erasing AC signal illustrated in a state that it is applied to the DC voltage applying terminal 10 within the vertical flyback period $T_{VBLK}$. (E) designates a variation in the scattering state of the liquid crystal cell in the same picture element as that containing the memory capacitor shown in FIG. (C). In the scattering state variation of (E), a continuous line the variation when the erasing AC signal is applied to the common electrode terminal 8 While a broken line indicates the variation when the voltage is absent. (F), (G) and (H) are the same as those shown in (B), (C) and (E), and relates to one picture element on the lower side of the panel face.

In the operations shown in FIG. 13, at time $T_1$ a white level of the video signal is charged into the memory capacitor 2 of a picture element on the liquid crystal panel by the signal (B). Also at time $T_2$, a signal with the same level has been applied to the same. At time $T_3$ a black level signal is applied to the capacitor. Generally, the same signals continue for several frames in the television signal and accordingly a waveform of the signal in the memory capacitor 2 is as shown in (C). For this, at time $T_1$ the scattering of the liquid crystal starts as illustrated by (E) and at time $T_4$ the erasing AC signal (D) is applied to the liquid crystal cell 1. Accordingly, the scattering state slightly returns to its original state. Since the voltage is still held in the memory capacitor 2, the liquid crystal state shifts to the scattering state again. At time $T_3$ the potential level in the memory capacitor 2 starts to shift to the black level. The level shift is more distinctive at time $T_5$ when the erasing AC signal is applied to the common electrode terminal. This leads to the shortening of the decay time. With respect to the scattering state of the liquid crystal, a rise time toward the white level is generally much higher than the decay time and the signals are continuously transmitted for the period of several frames. For this, the scattering state of the liquid crystal is substantially the same as that of the conventional one. On the other hand, the decay time is much shorter than that of the conventional device. Therefore, the response time of the liquid crystal is greatly improved. The waveform of (F), which relates to picture element on the lower part of the panel face, as mentioned above, rises insufficiently since the signal with the level corresponding to the white level is still held in the memory capacitor after the erasing AC signal (D) is applied to the common electrode at time $T_4$, as shown by (H). The erasing AC signal may easily be formed by a conventional oscillator circuit. A duty ratio of the erasing AC signal (pulse signal) is 1:1. This may be obtained from a signal synchronized with a horizontal signal, or an output signal from a horizontal oscillator circuit 51 used in a usual television receiver. In this case, the output signal is applied to the common electrode 8 having a DC voltage adjusted by the variable resistor 35, through the capacitor 53. The application of the erasing AC signal only during the vertical flyback period $T_{VBLK}$ may be realized by using a gate circuit 52 which is enabled in response to the vertical flyback period signal. The usual television signal has about 21 H (H is the number of horizontal lines and 1.3 msec) during the horizontal flyback period. Accordingly, the waveform of (D) indicates that an AC signal of 15.75 KHz is applied to the electrode with about 21 repetitions. In the above description, the erasing AC signal is applied to the common electrode terminal 8 only during the vertical flyback period $T_{VBLK}$. The constant application of the erasing AC signal is allowed. In this case, the rise time toward the white level is relatively slow. This problem may be solved by increasing the amplitudes of the parallel video signals from the video signal output circuit 7 or by adjusting the DC voltage at the common electrode terminal. The above-mentioned embodiment improves the response of the liquid crystal cell particularly by shortening the decay time, so that the after image on the liquid crystal panel is reduced to improve the picture quality.

As described above, the decay time of the liquid crystal may be reduced merely by applying the output signal from the horizontal oscillator circuit or another suitable oscillator. Accordingly, the conventional liquid crystal panel may be used as it is. Further, circuit components additionally required are only the capacitor 53 for coupling, and the gate circuit 52, if necessary. Accordingly, the picture quality of a picture displayed on the liquid crystal panel can be greatly improved. The liquid crystal display drive device according to the invention is very useful.

A still another embodiment will be described which improves the deterioration of the decay time of the liquid crystal caused by a decrease in ambient temperature.

Figure 14:
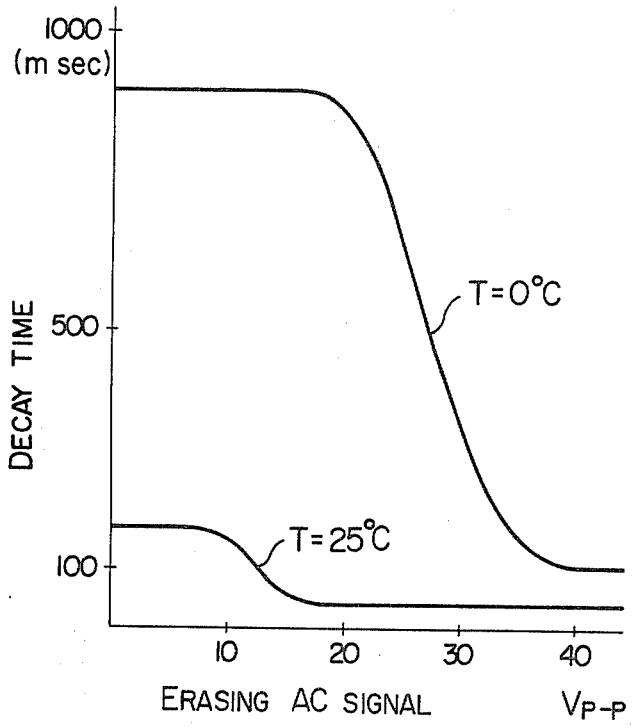
FIG. 14 shows a graph illustrating the relationship between the amplitude of an erasing AC signal and the rise time of a liquid crystal, with ambient temperature.
Figure 15:
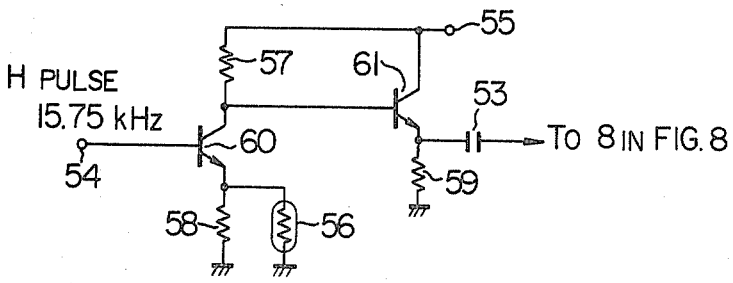
FIG. 15 shows a circuit diagram of a sixth embodiment which is a circuit for controlling in accordance with ambient temperature the amplitude of an erasing AC signal applied to the DC voltage at the common electrode terminal.

FIG. 14 shows a relationship between the decay time versus the amplitude of the erasing AC signal when the erasing AC signal is constantly applied to the common electrode terminal 8 in the above mentioned embodiment. In the graph of FIG. 14, ambient temperature is used as a parameter. As described above, when the erasing AC signal is applied to the common electrode continually, the rise time deteriorates relatively greatly. As the amplitude of the erasing AC signal increases, the rise time is slower. With this disadvantage in mind, the sixth embodiment employs an erasing AC signal with an amplitude selected by taking the rise time and the decay time into account at each temperature. The circuit diagram of this embodiment is illustrated in FIG. 15. Reference numeral 53 is a coupling capacitor which is the same as that of the same numeral. Numeral 54 is an input terminal for the erasing AC signal. 55 is a DC power source terminal, 56 a temperature-dependent resistor (the temperature coefficient is positive), 57 to 59 are fixed resistors, and 60 and 61 are transistors.

In the circuit, the erasing AC signal applied to the input terminal 54 is amplified by the transistor 60. The amplification degree of the transistor 60 changes with the resistance of the temperature dependent resistor 56 and increases as the temperature rises. The erasing signal amplified by the transistor 60 is applied through the transistor 61 and the coupling capacitor 53 to the common electrode terminal 8. Thus, as ambient temperature falls, the amplitude of the erasing AC signal applied to the common electrode terminal 8 is larger. In this way, the rise time and the decay time of the liquid crystal are set to proper values, regardless of a change in ambient temperature. Accordingly, a picture with a good picture quality, of which the afterimage is reduced, can be secured.

What is claimed is:

1. A brightness adjusting circuit of a liquid crystal matrix panel for picture display comprising:

an X-Y matrix panel having a plurality of picture elements each connected at one terminal to a semiconductor switching element and a memory element and at another terminal to an electrode common to all the picture elements;

a plurality of X electrodes and Y electrodes connected to control said semiconductor switching elements, whereby a gate signal applied to an X electrode transfers a voltage applied to said Y signal to said memory element;

means for applying a video signal to said Y electrodes;

means for applying a scanning gate signal to said X electrodes and for storing in said memory element the voltage corresponding to the video signal applied to said Y electrode by successively making the semiconductor switching elements conductive;

means for applying a variable DC voltage to said common electrode whereby the brightness of a picture displayed may be varied;

means for superimposing an AC signal with a frequency to which the liquid crystal does not respond on the variable DC voltage;

means for detecting the ambient temperature of said matrix panel; and means for controlling the DC voltage applied to the common electrode in accordance with the detected temperature.

2. A brightness adjusting circuit according to claim 1, wherein said AC signal is applied during a vertical flyback period.

3. A brightness adjusting circuit according to claim 1, wherein the amplitude of said AC signal superimposed to the DC voltage applied to said common electrode is increased as the ambient temperature decreases.

* * * * *